United States Patent [19]

Erickson et al.

[11] 4,190,749

[45] Feb. 26, 1980

[54] ROTARY THUMBWHEEL SWITCH ASSEMBLY

[75] Inventors: Richard W. Erickson, Glendora; James Pallaske, Covina; Stephen B. Talbert, Pasadena, all of Calif.

[73] Assignee: Becton, Dickinson Electronics Company, Pasadena, Calif.

[21] Appl. No.: 810,153

[22] Filed: Jun. 27, 1977

[51] Int. Cl.[2] ..... H01H 19/58

[52] U.S. Cl. ..... 200/11 TW; 200/294; 200/296; 200/307; 200/316; 206/223; 248/27.1

[58] Field of Search ..... 200/11 R, 11 D, 11 DA, 200/11 G, 11 J, 11 TW, 292, 294, 295, 296, 314, 316, 156, 237, 238, 252, 16 D; 248/27.1, 27.3

[56] References Cited

U.S. PATENT DOCUMENTS

| | | | |
|---|---|---|---|
| 3,140,377 | 7/1964 | Koci et al. | 200/316 |
| 3,222,465 | 12/1965 | Huntress et al. | 200/11 TW |
| 3,349,211 | 10/1967 | Lien | 200/316 |
| 3,372,260 | 3/1968 | Bell | 200/316 |
| 3,375,337 | 3/1968 | Barrett et al. | 200/11 TW X |
| 3,435,167 | 3/1969 | Pfleger | 200/11 TW X |
| 3,566,049 | 2/1971 | Wright | 200/11 TW X |
| 3,626,133 | 12/1971 | Teruzzi | 200/295 |
| 3,655,925 | 4/1972 | Lincoln et al. | 200/11 TW |
| 3,719,785 | 3/1973 | Kendall et al. | 200/11 TW |
| 3,941,965 | 3/1976 | Piber | 248/27.3 X |
| 3,958,087 | 5/1976 | Mol et al. | 200/156 X |
| 3,964,705 | 6/1976 | Giovanni | 248/27.1 |
| 4,002,873 | 1/1977 | Lewandowski | 200/314 |
| 4,048,560 | 9/1977 | Schwartz | 200/11 G X |
| 4,055,738 | 10/1977 | Beck | 200/296 |

FOREIGN PATENT DOCUMENTS

| | | | |
|---|---|---|---|
| 1206358 | 2/1960 | France | 200/11 G |
| 1591978 | 6/1970 | France | 200/11 TW |

OTHER PUBLICATIONS

Plessey Print Switch Catalog, Publication No. 4283, Feb. 1969.

*Primary Examiner*—James R. Scott
*Attorney, Agent, or Firm*—Marvin H. Kleinberg; Thomas A. Turner, Jr.

[57] ABSTRACT

A rotary thumbwheel switch assembly has a switch module including a translucent light ring for indicating positions of the rotary thumbwheel. The ring is illuminated from within by a light emitting diode which can be snap-mounted in place in the center of the translucent ring. The switch module comprises a thumbwheel to which contact brush sets can be easily secured by a spring biased tab. The switch module can be combined with a separable bezel. The switch module can be mounted from either side of a front panel, and can be connected to circuit assemblies housed by the panel prior to the insertion of the bezel. The bezel secures the switch modules to each other and to the panel. A kit comprising the separable elements of the illuminating diode, the bezel and the switch modules is described. A method for installing the separable elements includes the steps of inserting the modules from the front of the housing panel for testing each module's connection with circuit assemblies prior to installing the bezel.

28 Claims, 14 Drawing Figures

Fig. 6
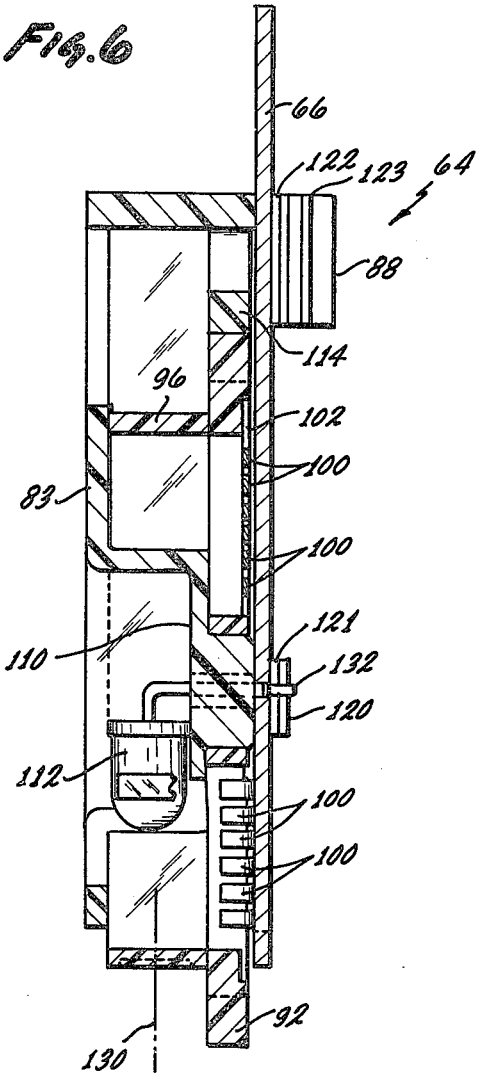
Fig. 7
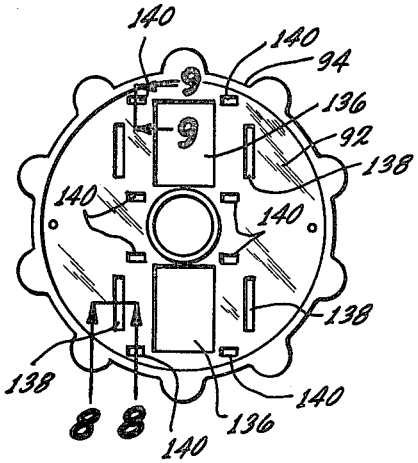
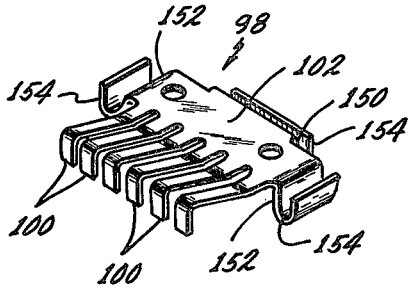
Fig. 10
Fig. 8
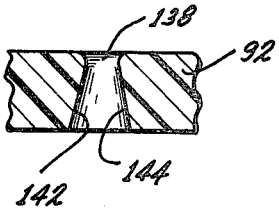
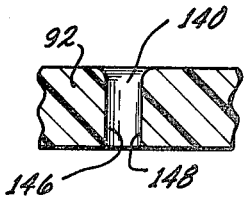
Fig. 9

FIG. 11
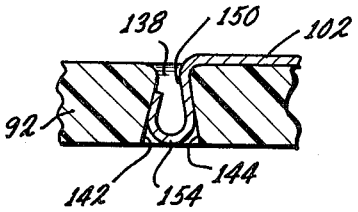
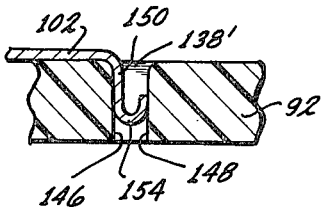
FIG. 12
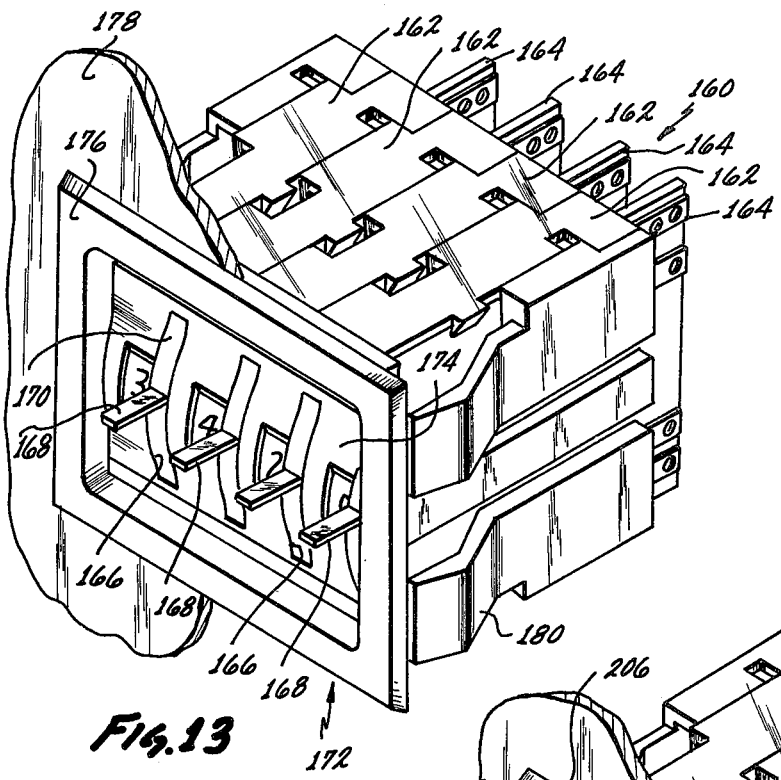
FIG. 13
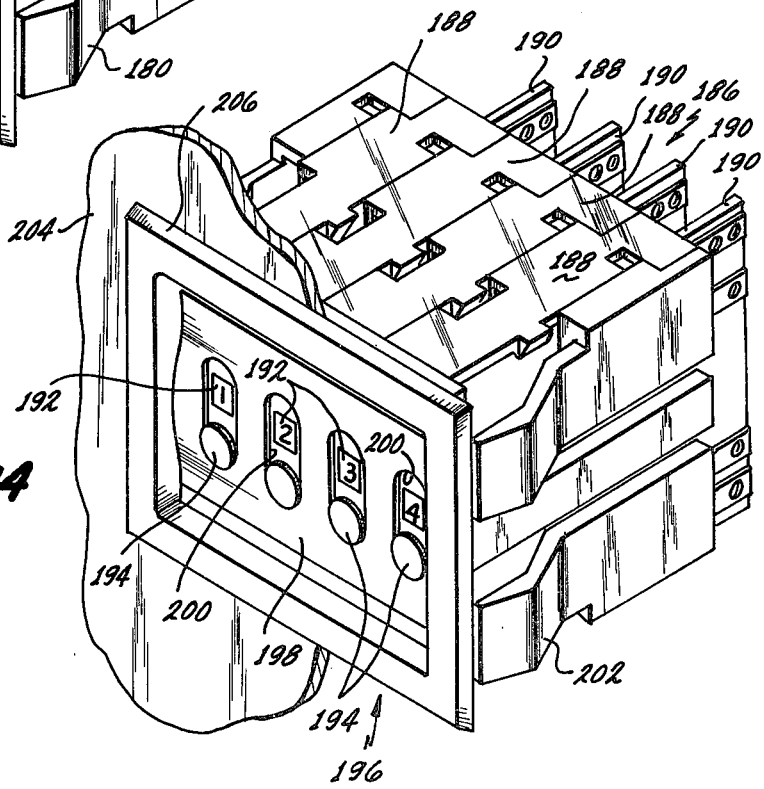
FIG. 14

ROTARY THUMBWHEEL SWITCH ASSEMBLY

BACKGROUND OF THE INVENTION

1. Field of the Invention

This invention relates to digital switch assemblies, and more particularly to switch assemblies capable of assembly by modules from the front of an instrument panel for providing a highly visible numerical display of switch circuits selected.

2. Description of the Prior Art

At least since 1959, the digital switch has been known to provide a convenient man to machine interface for digital equipment. Circuit assemblies are constructed capable of performing a selection of many different functions. The selection is frequently made by a rotary element type switch. The multiple leads of the switch are connected into the various circuit assemblies. Frequently, the circuit assemblies and switch arrangement are mounted in an enclosure having a front panel.

The switch rotary elements, when turned, selects various of the circuits in the assembly, according to circuit design. Frequently the rotary element is turned by the thumb, thus acquiring the name "thumbwheel" switch. Other switches utilize levers or push button operated ratchet mechanisms. Hereinafter in this description, the term "thumbwheel" will be used to describe a rotatable element having detents suitable for contact by a thumb or finger for rotation, and where clearly not contradictory, may include lever operated and push button rotary switch assemblies as well.

The thumbwheel usually has some means of providing multiple contacts to an adjacent printed circuit or wire board. The contacts frequently are brushes attached to a common, electrically conductive base so that when any two of the brushes contact separate conductive elements on the printed circuit board, the separate conductive elements are brought into common circuit. The terms "contact" and "brush" are frequently used interchangeably to denote the electrically conductive extensions from a common base in the brush set.

The rotating actuator and dial or thumbwheel, brush sets and printed circuit board are frequently constructed as a unit or module. It has been known in the past to construct such modules so that they can be combined in a series of such switches to form an assembly. Frequently, the module has end brackets and assembly straps or studs for interconnection with each other in a series. The assembly itself, further, might have special end units having special end brackets and assembly strips or studs for holding the modules in a pre-selected series order and for holding the assembly within the panel.

In the past, the switch modules frequently provide visible indicators so that one looking at the front of the panel or of the switch module assembly can instantly determine the rotary position of the switch thumbwheel. The indicators frequently are colored to contrast with the switch module and assembly so that they can be discerned with normal ambient light. With time and frequent rubbing with the fingers or thumb, the coloring is worn or discolored so that determining the rotary thumbwheel position is made difficult. Yet other applications are in dark environments where a contrast in coloring is insufficient to give the viewer an indication of the thumbwheel rotary position.

Such module assemblies frequently have a stationary face which is visible from the front of the panel into which the assembly might be constructed. The construction of such assemblies is divisible into two types, a rear mounted switch assembly and a front mounted switch assembly.

In the rear mounted type switch assembly, the series of modules are combined initially. Usually separate end units are attached to the ends of the module series to provide the necessary end brackets. The end brackets may be formed with holes through which screws or studs can be inserted to hold the assembly to the panel. It is usual to provide a hole in the panel into which the rear mounted switch can be inserted. This hole then must be "finished" in some aesthetically acceptable manner.

The fastening element is inserted through the holes in the end brackets and into additional fastening holes provided in the panel. Frequently, these holes in the panel extend through the panel so that some threaded fastening element, such as a nut or screw head is left protruding through the face of the panel.

Rear mounted type switch assemblies have been found desirable in situations where it is important to wire the switch modules to the circuits prior to the final mounting in the housing itself. It is frequently desired in such circumstances to test the switch assembly formed by the combined modules before the front panel is permanently attached to form the finished instrument product. The panel must be carefully attached, however, in order to have the switch assembly protrude through the desired finished opening or hole. The use of threaded fasteners for mounting the switch assembly to the panel is frequently called "hard mounting" the assembly.

The front mounted type switch assembly is used in situations where the panel is already fastened to the housing containing the circuit assemblies. The switch modules are assembled in a series, and as in the rear mounted assemblies, end brackets are combined on both ends of the module series to form the assembly. Thus the switch assembly includes a front face usually comprising a flange extending from the front of the assembly. The flange usually extends over a greater area than than of the hole in the panel, eliminating the requirement for "hole finishing".

The switch modules and the end brackets are frequently provided with tangs or similar type clamping arrangements. The switch assembly, then, can be inserted through the panel hole or opening. The tangs or similar type resilient clamping arrangements, clamp behind the panel to hold the assembly securely to the panel. The clamping arrangement usually obviates the need for unsightly screw holes and threaded fastening element protrusions forward of the panel itself. The use of resilient clamping arrangements is sometimes called "snap-in mounting".

Problems are frequently encountered using the front mounted type switch assembly. In particular, it may be appreciated that it is necessary to install the switch module into the panel itself before the circuit assemblies housed by the panel are connected with the switches. Preliminary testing may require that the modules must be reassembled in a different sequence. In the front mounted type switch assembly, therefore, the assembly must be removed from its permanent attachment to the panel for the necessary rearrangement.

Various arrangements of contact brush sets have been provided to secure the sets to the wheel. For example, some wheels are formed having studs over which the set, having matching holes, is fitted. The studs may be bradded or melted to secure the set. Such sets are attached to the wheel in a relatively permanent way.

Other systems include wheel face slots having simple extensions of the set inserted therein. In this regard, attention is directed to U.S. Pat. No. 3,466,407 issued to Will. Such a set can be removed, perhaps too easily, from the wheel in some circumstances.

It has long been sought to provide indicating arrangements associated with such rotary thumbwheel switch arrangements that will provide a back illuminated switch indicator, which might be viewed clearly in dark environments and after repeated rubbing with fingers and thumbs. Brush set attaching arrangements connecting the set to the wheel in a reliable but replaceable fashion is also desired.

It has also long been sought to provide a rotary switch assembly capable of modular construction and insertion into a panel from either side of the panel, prior to the permanent fixing of an escutcheon or other finishing plate or bezel to conceal an unfinished opening or hole.

SUMMARY OF THE INVENTION

A rotatable thumbwheel, in accordance with one aspect of the invention, is assembled in a module including a printed circuit board and module casing having a detent spring for engaging detents on the thumbwheel. The module includes a light emitting diode type light source for illuminating a translucent light ring integral with the thumbwheel. The light source is positioned near the center of the thumbwheel and within the attached translucent light ring to provide back lighting to the front panel of the module in any assembly in which the module might be assembled.

In accordance with one embodiment of the invention, a rotatable thumbwheel element is provided having slots or channel indentations in at least one of its opposing parallel faces. The channel indentations may be slots, extending through the thickness of the wheel. In another embodiment of the invention, channels are recessed in one face of the thumbwheel. Opposing sides of the channel can be made parallel to each other, or may alternatively flare away from each other. The thumbwheel can be provided with a plurality of such indentations for each contact brush set to be secured.

Contact brush sets are described having a common base. The base has tabs extending perpendicularly from a plane of the base and curving back upon itself to form a U-shaped member adapted to securely fit within the indentations. The U-shaped member provides a spring biasing to further secure the brush set in the indentation.

A plurality of such modules can be assembled in a series which can be inserted in an opening in a front of a panel. A separate bezel can be inserted from the front of the opening in the panel to secure the modules in the arranged series and to secure the modules to the panel. The bezel then provides a front "face" through which the thumbwheel protrudes and through which the indicating devices on the thumbwheel can be seen, as well as a decorative "frame" which conceals the hole in the panel through which the assembly extends.

A kit comprising assemblable parts which when assembled provides the unique front mounting separable switch modules and bezel is described. In a preferred embodiment a method of assembling a rotary thumbwheel switch assembly within a panel is taught and explained wherein the bezel is inserted after the front mounted switch modules are snap-in mounted from the front of the panel.

The novel features which are believed to be characteristic of the invention, both as to organization and method of operation, together with further objects and advantages thereof, will be better understood from the following description considered in connection with the accompanying drawings in which several preferred embodiments of the invention are illustrated by way of example. It is to be expressly understood, however, that the drawings are for the purpose of illustration and description only, and are not intended as a definition of the limits of the invention.

BRIEF DESCRIPTION OF THE DRAWINGS

FIG. 6 is an elevational, cross-section view of a switch module assembly of FIG. 4 taken along line 6—6 in the direction of the appended arrows;

FIG. 7 is a plan view of a thumbwheel according to a preferred embodiment of the invention;

FIG. 8 is a cross-sectional, elevation view of a portion of the thumbwheel of FIG. 7 taken along line 8—8 in the direction of the appended arrows;

FIG. 9 is an elevational cross-section view of a portion of the thumbwheel of FIG. 7 taken along line 9—9 in the direction of the appended arrows;

FIG. 10 is a perspective view of a brush set of the preferred embodiment of the invention.

FIG. 11 is an elevational, cross-section view of a portion of the thumbwheel having a brush set inserted therein;

FIG. 12 is an elevational cross-section view of an alternative embodiment of the thumbwheel of FIG. 7 showing a brush set as used combined therewith;

FIG. 13 is a perspective view of an alternative embodiment of the invention using lever operated switches, and FIG. 14 is a perspective view of another alternative embodiment of the invention using push button operated switches.

DESCRIPTION OF THE PREFERRED EMBODIMENT

Figure 1:
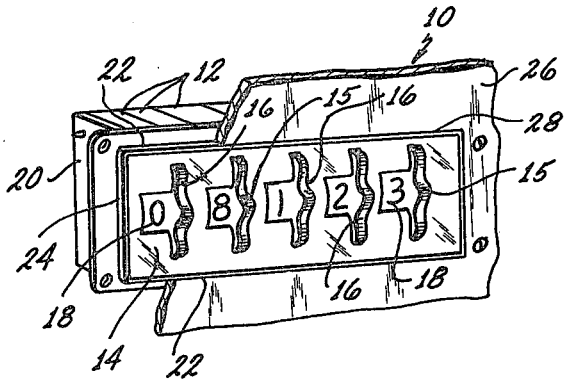
FIG. 1 PRIOR ART
FIG. 1 is a perspective view of a rear mounted digital switch assembly of the prior art.

Illustrating the prior art discussed above, the rear mounted digital switch assembly of FIG. 1 is shown. Although finger detented or thumbwheel switches are shown, it is understood that the concepts of the present invention are also applicable to lever and push button actuated rotary digital switches.

Individual switch modules 12 are assembled in series, side by side. Each switch module 12 has a face 14 through which detent 15 of a thumbwheel 16 protrudes. The thumbwheel 16 can be moved by finger contact with the protruding detent 15. Each thumbwheel 16 has an indicating element 18 clearly visible through the front cover or face of each module 12.

The lateral ends of the module series are bound by end brackets 20. Only the left side end bracket 20 is shown in FIG. 1. A similar end bracket can be found on the right side of the module series in most applications.

Each module 12 is provided with a slight flange 22 extending forward of the cover plane near both the top and the bottom of the module cover. The end brackets 20 have a corresponding flange 24 extending vertically from the top portion to the bottom portion of the front cover. When the modules 12 are assembled in the series and are collected within the end brackets 20, a continuous rectangular flange or frame appears, composed of the individual module flanges 22 and the end bracket flanges 24.

A portion of the front panel 26 of an instrument casing is shown greatly cut away but having a rectangular hole 28 cut therethrough. The hole is exposed to view in the front, and thus must be "finished". The hole 28 is cut precisely to receive the protruding flange composed of the individual flanges 22 and 24 of the module series. The individual modules 12 must be connected electrically to the circuit assemblies which are housed by the instrument casing, prior to insertion through the rectangular hole 28 cut in the face of the panel 26.

Figure 2:
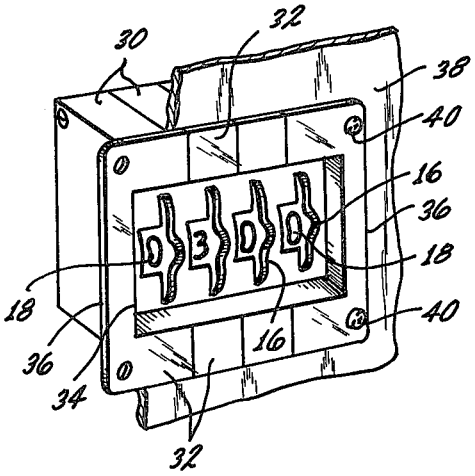
FIG. 2 PRIOR ART
FIG. 2 is a perspective view of a front mounted digital switch assembly of the prior art.

Referring next to FIG. 2, individual modules 30 are shown assembled in a series to illustrate the front mounted selector switch assembly. Each individual module 30 has a front face having openings through which a thumbwheel 16 protrudes, and through which the visual indicator 18 can be seen. Each module 30 further comprises an upper and a lower flange 32. End brackets 34 have a vertical flange 36 extending from the top portion to the bottom portion.

When the individual modules 30 are assembled in a series, they are bounded on the lateral sides by the end brackets 34. The entire assembly is then inserted through a hole cut in the front panel 38 of an instrument case. The flange ring created by the assembled individual flanges 32 and end bracket flanges 36 create a border around the hole in the panel 38. Thus the hole through the panel 38 need not be finished. Threaded fasteners 40 are inserted through holes prepared in the end bracket flanges 36 to secure the entire assembly to the panel 38.

Figure 3:
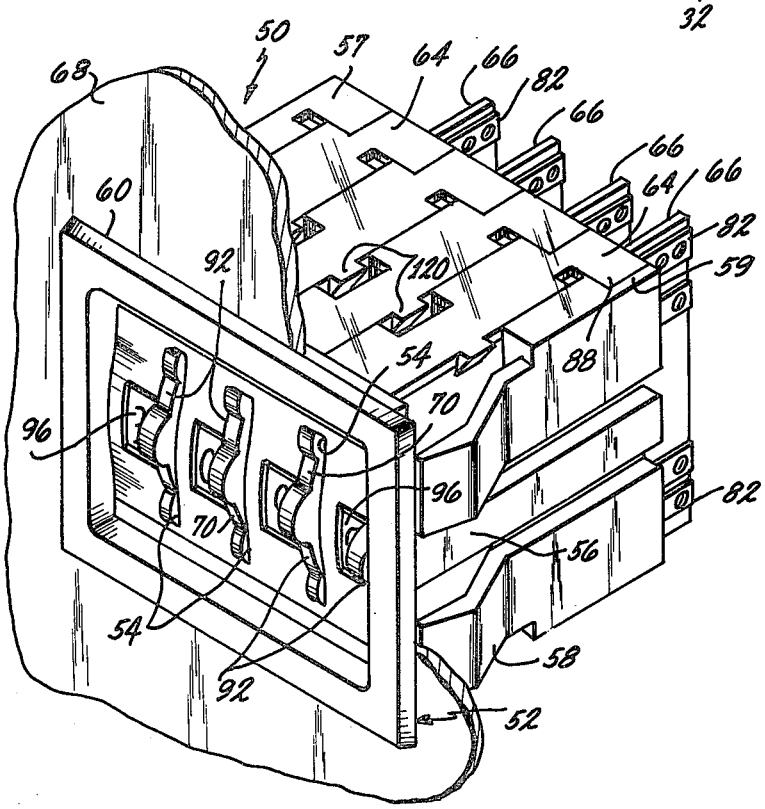
FIG. 3 is a perspective view of the preferred embodiment of a switch assembly of the present invention, showing an instrument housing substantially cut away.

To overcome certain disadvantages of these prior art rotatable selector switch assemblies, an improved rotary thumbwheel switch assembly 50 is shown, reference being had now to FIG. 3. According to a preferred embodiment the assembly 50 comprises a bezel 52 and a plurality of switch modules 64. Each switch module 64 has a printed circuit board 66 which extends beyond the assembly for electrical interconnection with circuit assemblies housed by an instrument enclosure or housing, represented partially by the cut away front panel 68.

The bezel 52 has a front mask or face having openings 54 through which the thumbwheel 92 can protrude for manual rotation by a finger. Each opening 54 is large enough to allow the indicia 70 of an indicating means 96 to be presented or viewed therethrough. The indicating means 96 will be described in greater detail below. The bezel 52 is sometimes called an "escutcheon plate".

The bezel 52 has side stubs 56 positioned on the opposing lateral sides and extending away from the face. The stub connects tangs 58 which resiliently extend outside the plane of the stubs 56. The tangs 58 are adapted to resiliently engage the rear face of the panel 68 for securely holding the bezel 52 to the panel 68.

The stub 56 and tang 58 structure on the right side of the bezel 52 seen in FIG. 3 provides a receptacle 59 for receiving a positioning stub 88 of the module 64. On the left side of the bezel 52, a similar stub and tang structure provides a positioning stub 57. This stub 57 fits into a receptacle formed in the left side of the module 64. The modules 64 arranged in a series are thereby kept together by the end bezel stub and tang structures.

The bezel 52 has a border frame 60 surrounding the front face. The frame 60 is adapted to overlap the edges of the hole cut in the panel 68. The hole cut in the panel 68 for inserting the modules and the bezel, therefore, need not be finished.

If desired, the front mask of the bezel 52 may have a curvature complemental to the curvature of the thumbwheel 92 extending through the openings 54. This curvature can be seen better in FIG. 4 of the drawings.

Figure 4:
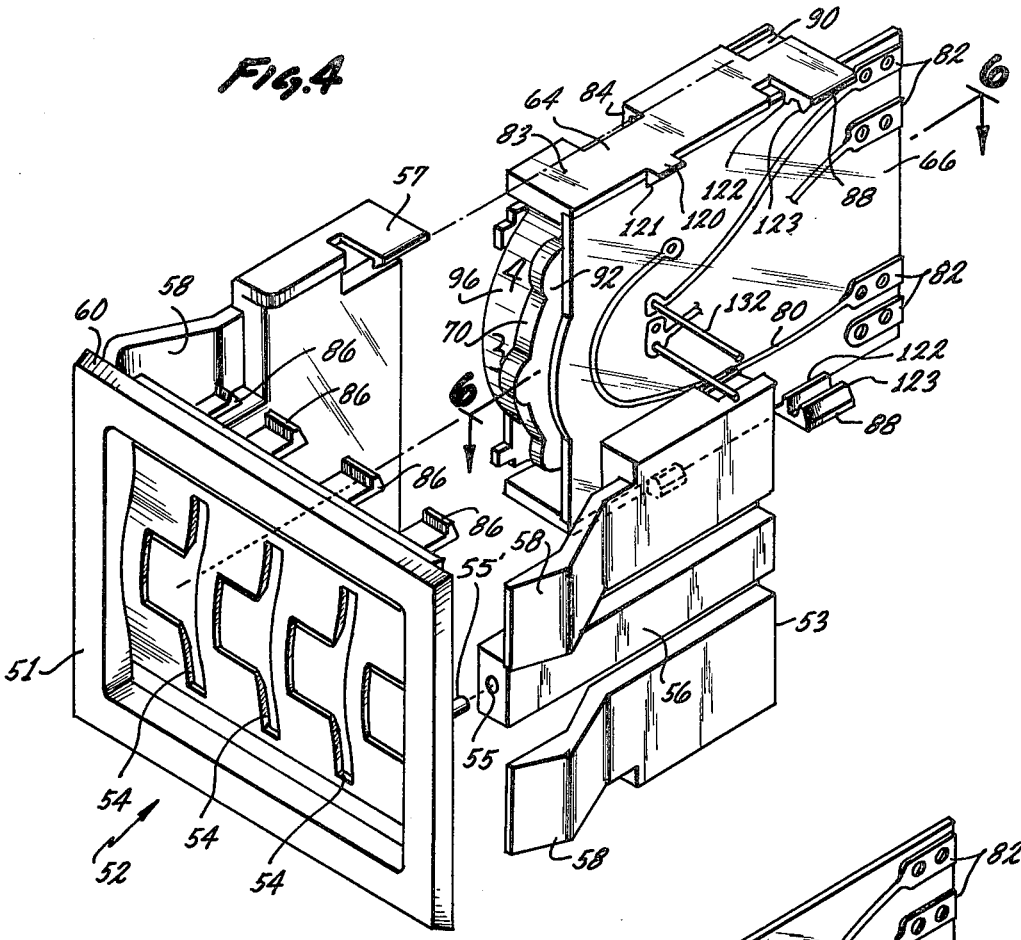
FIG. 4 is a partially exploded perspective view of a preferred embodiment of the switch assembly of the present invention, showing only one switch module for clarity.

FIG. 4 of the drawings show the bezel 52 having a switch module 64 exploded or separated apart. Only one module 64 is shown in the view of FIG. 4 in order to provide additional space and clarity in illustration.

It is contemplated that the bezel 52 and modules 64 will be delivered separately to the point of use. The module 64 can be inserted through the opening prepared in the panel of an instrument case. The printed circuit board 66 has circuits 80 printed or etched thereon. These circuits are connected with terminals 82 on an edge of the board extending beyond the main body of the module itself. These terminals 82 connect with terminals of circuit assemblies housed by the instrument panel.

The module 64 has a frame 83. The frame 83 has an opening 84 in both the uppermost side as shown in FIG. 4, and the lowermost side seen in FIG. 5. The bezel is constructed having a plurality of ratchets arranged in rows and sets. One row of ratchets 86 is arranged along the top edge of the rear side of the bezel 52, each ratchet having a detent pointing upwardly. A similar row of ratchets, not shown, is arranged opposite the upper row of ratchets along the bottom edge of the rear side of the bezel 52, each ratchet having a detent pointing downwardly. A set of ratchets, comprising one ratchet along the top edge and one ratchet along the bottom edge of the bezel 52, engages the upper and lower openings 84 in the module frame 83. The module 64 is thus securely attached to the bezel when the bezel is inserted from the front over the module 64, when the ratchets 86 insert within the module 64.

The bezel 52 itself can be separated into the front mask 51 and end brackets 53 to provide greater ease of assembly. The side stub 56 is provided with a receiving slot 55. The receiving slot 55 is aligned with a stud 55' on the rear side of the border frame 60. The stud is preferably snap-mounted within slot 55 for ease in separating the front mask 51 from the end brackets. The modules can then be easily withdrawn from the front of panel 68, as will be described in greater detail below.

Each module is constructed having studs 88 extending from both the upper face and the lower face of the frame 83. These studs 88 are adapted to be received by receptacles 90 formed on the upper and lower faces of adjacent frames 83.

As explained above, a stud 57 is formed on the left end bracket 55. When the module 64 receives the ratchets 86 to securely position the module 64 relative to the bezel 52, the stud 57 inserts into the receptacle 90 of module 64. Studs 88 on the module 64, similarly, engage receptacles in adjacent modules as indicated by the module series illustrated in FIG. 3. The modules 64 in a series, therefore, are fixed relative to each other.

The module series, further, is fixed within the bezel frame. The rightmost module 64 has a stud 76 which engages the receptacle 59 in the end bracket 55 of the structure of the bezel 52. The detents of the thumbwheel 70 extend through the bezel mask openings 54 so that they can be manipulated by the fingers of an operator. The indicator wheel 92 explained more fully hereinbelow, is clearly presented through the same openings 54.

Figure 5:
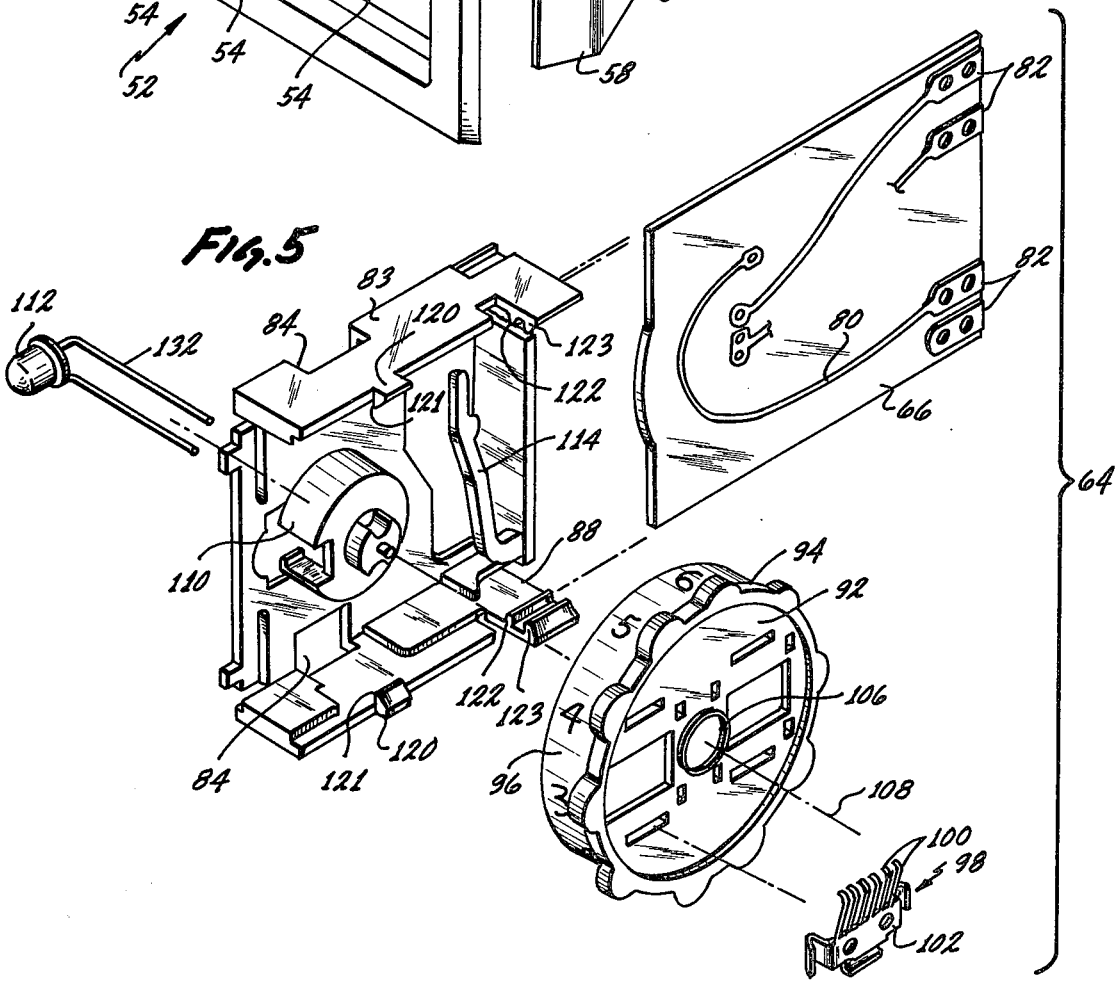
FIG. 5 is an exploded view of a switch module assembly according to a preferred embodiment of the invention.

In FIG. 5, an individual module 64 has been exploded to reveal the interrelationship of the components and some detail of the interior elements. In FIG. 5, the printed circuit board 66 is shown having circuits 80 printed or etched thereon. The printed circuits 80 terminate in terminals 82 which connect to circuit assemblies within the instrument cabinet or housing. The circuit board 66 itself can be made in the usual manner, having a fiberglass core with various circuit connecting holes drilled or formed therein.

The thumbwheel 92 is formed having detents 94 formed around its periphery. Thd detents 94 are curved to receive a finger or a thumb and are designed to fit through the openings 54 in the face of the bezel. The thumbwheel 92 has a numerical indicating wheel 96 integrally attached thereto. Thus when the thumbwheel 92 is turned, the indicating wheel 96 is equally turned. The indicating wheel constitutes means having on its face numerals etched to be transparent or translucent to light.

The thumbwheel 92 has brush sets, of which one brush set 98 is shown in FIG. 5 for illustration. The brush set 98 has a plurality of extending contacts or brushes 100 connected to a common base 102. The brushes 100 extend resiliently from the face of the thumbwheel 92 to engage circuits on the far side of printed circuit board 66. Details of the brush set are explained in greater detail hereinbelow.

The thumbwheel 92 has an opening 106 symmetrical about axis 108. The opening 106 is adapted to fit over cylindrical housing 110 formed on the frame 83. The light housing 110 houses light emitting diode (LED) 112. The housing 110 has an opening face toward the front in a line with the expanded portions of the openings 54 in the face of the bezel 52. When the thumbwheel 92 is butted over the housing 110, the indicating wheel 96 covers or intercepts light radiating from the diode 112. The translucent or transparent numeral etchings on the indicator wheel 96 permit a formed light radiation to extend from the diode 112 therethrough, and through the openings 54 to reveal the number between the light 112 and a viewer in front of the instrument panel. Thus the radial position of the thumbwheel 92 is constantly determinable by a viewer as long as the diode 112 is electrically connected.

The frame 83 has a spring biased pawl 114 formed to the rear thereof. The pawl 114 engages the detents 94 of thumbwheel 92 when the thumbwheel 92 is rotatably assembled over the housing 110. Thus slight pressure is required by the thumb or finger to move the thumbwheel rotationally about the axis 108. The thumbwheel 92 is thus maintained in a particular preselected position until a change is desired.

The module 64 is specifically designed for easy disassembly. It may be preferred indeed to provide the components of the module 64 in a kit form so that a user can assemble it in his own design. In any event, it is advantageous to be able to easily disassemble the circuit board 66 and the thumbwheel 92 with its indicator wheel 96 from the frame 83. It is further desirable to be able either to substitute brush sets 98 into various positions on the wheel 92 or to substitute different wheels 92 in the module assembly 64 itself.

The frame 83, accordingly, is provided with upper and lower studs 120. The wheel 92 has its opening 106 easily and rotatably mounted on the housing 110. The printed circuit board 66 is then snapped into and between the studs 120. The studs 120 can be formed having inwardly directed ratchets 121 for securely holding the printed circuit board 66 to the frame 83.

The studs 88 likewise can be formed with a second inwardly directed ratchet 122 parallel to the ratchets 121. The printed circuit board 66 thus is held to the frame 83 at four points. The printed circuit board 66 also forms a securing means for holding the thumbwheel 92 within the module 64 and rotatable about the housing 110. The second inwardly directed ratchets 123 on studs 88 are used to secure one module 64 to an adjacent module, as explained.

The detents 94 in the assembled module 64 are engaged by the pawl lever 114 to firmly maintain a preselected rotational position of the thumbwheel 92. In the assembled module 64, the resilient and extended brushes 100 of the brush set 98 firmly engage the printed circuit board 66 and make electrical contact with the conductive circuits 80 on the far side of the board 66 not seen in FIG. 5. Light radiating from the diode 112 extends through the translucent portions of the wheel 96 so that it can be seen as formed by the translucent portions, by a viewer looking at the openings 54 of the bezel 52. It is to be noted that in the assembled module 64, no front face or cover is provided, since the common mask of bezel 52 provides this function.

FIG. 6 is a cross-sectioned elevation view of the module 64 taken along line 6—6 of FIG. 4. In FIG. 6, the housing 110 can be seen formed in the frame 83. The thumbwheel 92 has formed integrally therewith the indicating or indicia means 96. The printed circuit board 66 is assembled to hold the thumbwheel 92 rotatably about the housing 110.

The housing 110 has an opening facing the front of the module 64, which is at the bottom of the illustration of FIG. 6. Light radiating from the light emitting diode 112 passes through the indicating means 96 in a beam indicated by the center line 130.

The light emitting diode 112 is placed in a circuit by connection with leads 132. The leads 132 can be connected to a power source. The leads 132 might be connected to a commutator ring on the printed circuit board 66, where the ring is connected by circuits 80 on the board directly to a source of power through appropriate terminals 82. If desired, therefore, the circuit design of the printed circuit board 66 could be capable of turning the light emitting diode off if certain predetermined conditions exist.

While the indicating means 96 is shown having Arabic numerals etched to provide windows for light passing therethrough, any other symbol might as easily be formed on the translucent window. For example, "ON" and "OFF" could constitute two of the indicia on the wheel 96. Other symbols as desired may be selected.

One side face of the thumbwheel 92 is seen in plain view in FIG. 7. The thumbwheel 92 has detents 94 formed consistently around its circumference. The opening 106 is symmetrical around the axis 108 of rotation. Rectangular windows 136 are formed through the wheel. Means for securing brush sets to the thumbwheel is provided in the form of indentations 138 and 140. The indentations 138, 140 form channels or slots receiving extensions from brush sets to securely hold the brush set to the thumbwheel 92.

A cross-sectional view of the slot forming the indentation 138 can be seen in FIG. 8. The slot 138 is formed having opposing sides or faces 142 and 144. Side 142 extends flaring away from side 144 as it is formed from the top face to the bottom face of wheel 92. Similarly, the opposing side 144 flares outwardly from side 142 as it extends from the top face to the bottom face of the wheel 92. It is not necessary to have this flare. Using some manufacturing techniques, the indentation may be formed having parallel sides.

Furthermore, the indentation may be formed only partially through the thickness of the wheel 92 so as to form a channel or a groove. Such a channel or groove is depicted in FIG. 9, a cross-sectional elevation taken along line 9—9 in FIG. 7. The opposing sides 146 and 148 are parallel to each other. The channel or groove 140 extends only partially through the thickness of the wheel 92.

A brush set is shown in perspective in FIG. 10 having brushes 100 extending outwardly from a common base 102. The base 102 connects the individual contacts or brushes 100 conductively to each other. Extending perpendicularly from the three sides of the common base 102 are securing tabs 150 and 152. Each of these tabs 150, 152 is formed curving back on itself to form a U-shaped member 154. The brush set 98 is formed from a single cut of a resilient, electrically conductive material. Thus each tab 150, 152 curving back on itself in the U-shaped member 154 forms a slight spring.

The base tab 150 is inserted into a longitudinal indentation 138 so that the U-shaped member is fully within the indentation 138. The resilience of the material from which the tab 150 is formed causes the U-shaped member 154 to expand between the flaring sides 142 and 144. This resiliency creates a spring biasing which securely holds the extension 150 within the slot 138, and thus securely holds the brush set to the wheel 92, as seen in FIG. 11.

The tabs 150 are inserted in the channels 140. The opposing faces of the U-shaped member 154 are urged by the resilient material from which the brush set is formed, against the opposing sides 142, 144 as seen in FIG. 11, or of the slightly modified channel 138' as seen in FIG. 12. This spring biasing securely holds the tab within the channel and assists in holding the brush set 98 to the wheel 92. Tabs 152 are similarly held within indentations 140.

It should be understood that a longitudinal indentation 138' could be formed having parallel opposing sides or faces from one face of the thumbwheel to the opposite face thereof as shown in FIG. 12. Alternatively, the indentation 138 could be formed as a groove or channel similar to the groove or channel 140. In like manner, the indentations 140 could be formed having flaring opposing sides. Furthermore, the flaring opposing sides in the indentations 140 could extend all the way from the top face to the bottom face of thumbwheel 92.

It may be appreciated that the flaring sides present a more secure holding arrangement for the spring biasing U-shaped members 154. The parallel sides of indentations, however, have been found suitable and quite satisfactory in actual use.

Summarizing, it can be seen that a most useful and advantageous method of assembling rotary thumbwheel selector switch assemblies into circuit assemblies housed in an instrument panel housing has been shown. The individual thumbwheel selector switch assembly can be inserted through the front panel of the instrument cabinet from the front face of the panel, and electrically connected to the circuit assemblies. The switch modules 64 comprising the assemblies can be secured in a series to adjacent switch modules 64. After testing and ascertaining that the switch modules are positioned in their correct series order, a bezel 52 can be inserted through the hole cut in the front panel of the instrument housing or cabinet. The bezel 52 can be inserted through the hole from the front face of the panel, as were the switch modules 64. The bezel 52 forms a front mask for each of the switch modules, and overlaps the edges of the hole in the instrument panel. Thus the hole in the instrument panel need not be finished. This two part bezel 52 and switch module 64 combination can be supplied in a kit form to a user for direct assembly at the point of use.

The individual switch module 64 is formed from four parts and is easily disassembled and reassembled. The switch module 64 has a light emitting diode 112 positioned within rotatable indicia means attached to the thumbwheel 92. Light radiating from the diode 112 passes through formed indicia on the indicating means to present through openings 54 in the bezel 52 an indication of the position of the thumbwheel 92 even in dark environments.

The printed circuit board 66 forming a part of the switch module 64 is snapped onto the module frame for easy assembly and disassembly. The printed circuit board 66 can be replaced by a differently designed printed circuit board to completely change the operating characteristics of the switch module assembly.

Contact brush sets 98 are uniquely attached to the thumbwheel 92 for secure contact with the snapped-in printed circuit board 66. The brushes or contacts 100 on the brush sets extend from a common base 102 having perpendicularly exending tabs 150, 152 for holding the brush sets 98 onto the thumbwheel 92. The thumbwheel 92 is provided with slots or channel indentations 138, 140 for receiving the brush set base tabs 150, 152. A U-shaped member on the base tabs resiliently fits within a slot or channel to securely hold the brush set to the thumbwheel 92. The slots or channels can be formed having flaring opposing sides with at least one entrance opening narrower than the width of the indentation itself, thus impairing the ability of the brush set to remove from the thumbwheel.

The switch module 64 can be easily assembled and disassembled so that substitute indicia for the indicating means 96 and substitute brush sets 98 having different brush or contact configurations can be designed into the module. A user can assemble the switch module 64 at the point of use using one of a selection of printed circuit boards and one of a selection of different thumbwheels and thumbwheel indicating means.

FIG. 13 shows a perspective of a selector switch assembly 160 embodying the mechanical lever switch module. As in the thumbwheel assembly, individual modules 162 are arranged in a series as shown. Each module 162 includes a printed circuit board 164 against which the contacts of the brush sets are held, a wheel and indicia means 166. The wheel holding the brush sets is rotated by a lever 168 which protrudes through an opening 170 in the bezel 172.

The lever 168 is connected by internal gearing usually including a ratchet wheel and pawl system, to the wheel bearing the brush sets. One pump of the lever 168, a turn of approximately 90°, frequently is designed to move the wheel several stations indicated by the indicia means. A lever switch per se is shown and described in U.S. Pat. No. 3,958,087.

The bezel 172 has a front cover or mask 174 and a frame 176. The frame 176 fits over the edges of the hole cut in the front panel 178 of the instrument housing, shown greatly cut away in both FIGS. 13 and 14. The bezel 172 has resilient snap-on mounting means 180 similar to the embodiment having a thumbwheel described above.

In all other respects, the lever operated wheel system of FIG. 13 is similar to the thumbwheel system. The individual switch modules 162 need not have finished front covers. The bezel front mask 174 will provide a suitable facing, and will allow the insertion of the modules from the front of the instrument housing before the bezel is inserted.

A push button module embodiment is illustrated in FIG. 14. Push button modules 188 are arranged in a series. Each module 188 has a printed circuit board 190 and a wheel urging contacts of the brush sets thereon into contact with circuits printed on the board 190.

The module 188 has indicia means 192 indicating the position of the wheel. The wheel is operated by depressing the push button 194. A ratchet mechanism links the pushbutton 194 with the wheel. A push button switch may be seen in U.S. Pat. No. 3,260,806 issued to Jeans.

A bezel 196 includes a front mask 198 having openings 200 through which the push button 194 protrude, and through which the indicia means 192 can be seen.

Resilient snap-on mounting means 202 secures the modules 188 together in the pre-arranged series. The mounting means 202 further secures the bezel 196 to the front panel 204. The bezel frame 206 covers the rough finish of the hole in the front panel. In other respects, the assembly operates in a manner similar to the operation of the thumbwheel assembly 50.

Although particular embodiments of the present invention have been described and illustrated herein, other embodiments of the present invention and modifications of these embodiments can be perceived by those skilled in the art without departing from the present invention. Accordingly, it is intended that the present invention should be limited only by the scope of the claims appended below.

What is claimed is:

1. A rotary switch assembly capable of assembly in fixed relation to an instrument panel having a front face and a rear face, including switch module means including at least one switch module, for providing selectable switched circuit connections, each switch module comprising:

a brush set having a plurality of electrically conductive and connected contact brushes, circuit means for presenting multiple circuit combinations to contacts of the brush set, a rotatable element adapted to be rotated about its center and including indicia means for visually presenting an indication of the rotary position of the rotary element, and further including means for securing at least one said contact brush set, and solid state illuminating means positioned within said indicia means and integrated with and responsive to said circuit means for illuminating the presented indicator from within said indicia means to an observer.

2. The rotary switch assembly of claim 1 wherein said indicia means comprises a translucent light ring having a center of rotation coincidental with the center of rotation of said rotatable element, said ring being fixed to said rotatable element.

3. The rotary switch assembly of claim 2 wherein said illuminating means comprises a light emitting diode positioned proximate the translucent ring center and opposite said rotatable element from said circuit means.

4. The rotary switch assembly of claim 3 wherein said light emitting diode is adapted to be snap-in mounted within the said indicia means, and wherein the said light emitting diode includes two electrically conductive nodes adapted for selective electrical contact with said circuit means.

5. The rotary switch assembly of claim 4 wherein said multiple circuit combination presented by said circuit means are adapted to selectively connect electric power to said light emitting diode when said rotatable element is selectively rotated about its center at predetermined rotary positions.

6. A rotary switch assembly capable of assembly in fixed relation to an instrument panel having a front face and a rear face, comprising:

switch module means including at least one switch module, for providing selectable switched circuit connections, said switch module means being capable of insertion within an opening in the panel from either face of the panel, each switch module comprising:

a brush set having a plurality of electrically conductive and connected contact brushes, circuit means for presenting multiple circuit combinations to contacts of the brush set, a rotatable element adapted to be rotated about its center and comprising indicia means for visually presenting an indication of the rotary position of the rotary element, and including means for securing at least one said contact brush set, and solid state integrated illuminating means positioned within said indicia means for illuminating the presented indicator; and a bezel adapted for insertion through the opening in the panel from its front face for partially covering the switch module means, said bezel including a plurality of front face openings through which a rotatable element may protrude and through which said indicators may be presented, said bezel further including means for securing a predetermined number of switch module means to said bezel and to the panel.

7. The rotary switch assembly of claim 6 wherein said indicia means for visually presenting an indication comprises a translucent light ring having a center of rotation coincidental with that of said rotatable element, said ring being fixed to said rotatable element.

8. The rotary switch assembly of claim 6 further comprising circuit assemblies constructed adjacent the rear face of the panel and adapted to be operable upon selective switching of said switch module means.

9. The rotary switch assembly of claim 8 wherein the switch means is operable to provide selectable switched circuit connections to operate the circuit assemblies before said bezel is secured to said switch module means and to the panel.

10. The rotary switch assembly of claim 6 wherein rotatable element comprises opposed sides, and said means for securing at least one contact brush set includes at least one indentation within and recessed from a side of said rotatable element; and wherein each said contact brush set comprises a common base connecting each of said contact brushes, said common base having at least one tab extending perpendicularly from said base and curved back upon itself to form a U-shaped member adapted to fit wholly within a said indentation.

11. The rotary switch assembly of claim 10 wherein at least one of said identations does not extend through the rotatable element.

12. The rotary switch assembly of claim 10 wherein at least one of said indentations extends through said rotatable element, said indentation providing a first entrance opening and a second entrance opening for insertion of the U-shaped member from corresponding opposed first and second sides of the rotatable element.

13. The rotary switch assembly of claim 12 wherein at least one of said indentations has at least two parallel sides extending from the first entrance opening to the second entrance opening.

14. The rotary switch assembly of claim 12 wherein said at least one indentation has at least two sides progressively flaring from each other from said first entrance opening to said second entrance opening.

15. The rotary switch assembly of claim 6 wherein said rotatable element further includes a wheel, and lever means coupled to said wheel for rotating said wheel upon manual operation of the lever means.

16. The rotary switch assembly of claim 6 wherein said rotatable element further includes a wheel and a push button means coupled to said wheel for rotating said wheel upon manual operation of the push button means.

17. A kit comprising at least two elements capable of assembly into a rotary switch assembly, the kit comprising:

a first element comprising at least one switch module having brush sets having a plurality of electrically conductive and connected contact brushes, circuit means for presenting multiple circuit combinations to contacts of each brush set, a rotatable wheel element adapted to be rotated about its center, said rotatable wheel element comprising indicator means for visually presenting an indication of the rotary orientation of said rotatable wheel element, said rotatable wheel element further comprising means for securing at least one said contact brush set, said switch module further comprising a solid state integrated illuminating means positioned within said indicator presenting means for illuminating the presented indication; and a second element comprising a bezel for receiving, by snap-in mounting, a plurality of said switch modules, said bezel including a plurality of front face openings through which actuating means for rotating said rotatable wheel element may protrude upon assembly, and through which said indication may be viewed after assembly, said bezel further including combining means for securing the bezel to the switch modules and means for securing the bezel to an instrument panel having an unfinished opening therethrough.

18. The kit of claim 17 wherein said illuminating means comprises a light emitting diode adapted to be connected in circuit with the circuit means.

19. The kit of claim 17 wherein each said switch module is capable of assembly from a kit comprising at least three parts, a first part comprising said circuit means for presenting multiple circuit combinations, a second part comprising said rotatable wheel element which includes said indicator means and said means for securing, and a third part comprising at least one contact brush set, wherein said rotatable wheel element has a first side face and a second side face having a common center of rotation, at least one of said faces having indentation means for securing a contact brush set thereto, and wherein each contact brush set includes a plurality of contact brushes integrally connected to a common base having at least one mounting tab extending perpendicularly from the base and curved back upon itself to form a U-shaped member adapted to fit with pressure bias within said indentation means.

20. The kit of claim 19 wherein said indentation means comprises channels each having at least two opposing sides progressively flaring from each other from a first face of said rotatable wheel element, and wherein upon assembly the U-shaped member is pressure inserted into said channel, and wherein the pressure biasing prevents easy disassembly of said brush contact set from said rotatable wheel element.

21. The kit of claim 17 wherein said rotatable wheel element is a thumbwheel.

22. The kit of claim 17 wherein said first element further comprises lever means coupled to said rotatable wheel element for rotating said rotatable wheel element about its center upon manual operation.

23. The kit of claim 17 wherein said first element further comprises pushbutton means coupled to said rotatable wheel element for rotating said rotatable wheel element about its center upon manual operation.

24. A method for assembling a rotary switch assembly into an instrument housing having a front panel with a front surface and a rear surface, the method comprising the steps of:

(a) forming an unfinished hole in the front panel opening to the front surface and to the rear surface thereof;

(b) inserting at least one switch module from the front surface through said front panel hole, and connecting the switch module to circuit assemblies within the instrument housing;

(c) inserting a bezel having a front mask including openings therethrough, from the panel front surface through said unfinished panel hole; and (d) snap-in mounting said bezel to hold said at least one switch module to said bezel, and to secure said bezel to said front panel, to expose elements of the switch module through said bezel front mask openings while finishing the appearance of said front panel.

25. The method of claim 24 wherein said switch module inserting step includes the insertion and connection of a plurality of switch modules to the circuit assemblies, and wherein further said plurality of switch modules are mechanically intercoupled with each other.

26. The method of claim 25 wherein between said switch module inserting step and said bezel inserting step, a step of testing the switch modules connected with the circuit assemblies is performed.

27. The method of claim 24 further including the step of assembling a contact brush set to a rotatable wheel to create the at least one switch module, where in this assembling step a U-shaped member extending perpendicularly from a base of the brush set is inserted into channels formed in a side surface of the rotatable wheel.

28. The method of claim 27 wherein the channels have opposing sides flaring from each other as the channel extends from the surface of the rotatable wheel, and wherein the assembling step pressure biases the U-shaped member against the opposing sides of the channel to form a substantially permanent assembly of the brush set with the rotatable wheel.

* * * * *